US005327766A

United States Patent [19]

Humphreys

[11] Patent Number: 5,327,766

[45] Date of Patent: Jul. 12, 1994

[54] APPARATUS FOR BENDING METAL WOOD GOLF CLUB HEADS

[75] Inventor: Todd F. Humphreys, Newark, Ohio

[73] Assignee: Ralph Maltby Enterprises, Inc., Newark, Ohio

[21] Appl. No.: 252

[22] Filed: Jan. 4, 1993

[51] Int. Cl.[5] ..... B21D 11/12

[52] U.S. Cl. ..... 72/316; 72/293; 33/508

[58] Field of Search ..... 72/316, 293, 295, 33, 72/34, 32, 35, 458; 269/909; 33/508

[56] References Cited

U.S. PATENT DOCUMENTS

| | | | |
|---|---|---|---|
| 1,118,056 | 11/1914 | Ross | 72/458 |
| 1,324,693 | 12/1919 | Rush | 72/458 |
| 1,690,592 | 11/1928 | Newland | 72/458 |
| 1,912,828 | 6/1933 | Countryman | 72/458 |
| 2,425,556 | 8/1947 | Nielsen | 72/458 |
| 3,357,219 | 12/1967 | Hunter | 72/35 |
| 3,439,429 | 4/1969 | Sundstrom | 33/508 |
| 3,965,714 | 6/1976 | Beard | 72/32 |
| 4,094,072 | 6/1978 | Erb | 72/293 |
| 4,640,017 | 2/1987 | Cukon | 72/293 |
| 4,804,184 | 2/1989 | Maltby | 273/77 |

FOREIGN PATENT DOCUMENTS

| | | | |
|---|---|---|---|
| 498408 | 5/1930 | Fed. Rep. of Germany | 72/458 |

OTHER PUBLICATIONS

Mitchell, Ed, "Centre Page TM," Official Publication of Centre Golf TM, vol. 3, No. 1, Jan. 1992.

Operating Instructions for Steelclub Angle Machine TM, Centre Golf, Centerville, Ohio.

Centre Golf Catalog, Centre Golf, Centerville, Ohio.

*Primary Examiner*—David Jones

*Attorney, Agent, or Firm*—Killworth, Gottman, Hagan & Schaeff

[57] ABSTRACT

Apparatus is provided for bending hosels of metal wood golf club heads to alter the characteristics of golf clubs incorporating the heads. A club head is clamped into a rigid clamping framework using a pair of clamps which engage the top and the back of the club head. A bending bar having an adjustable throat for engaging the hosel of the club head is then used to bend the hosel as required. The throat of the bending bar is defined by material which is softer than the golf club head to substantially eliminate marring of the club head. The back of the club head is engaged by an elongated pad of polymeric material formed to receive the back of the club head and the top of the club head is engaged by a pair of club head gripping areas formed to spread the top head gripping forces over two relatively large areas. The top gripping areas are formed as a single polymeric pad which is bifurcated to define the gripping areas. The top gripping areas are also separated from one another by a distance which places the gripping forces substantially over the toe and heel portions of the club head which are better able to withstand the application of force without denting or crushing.

20 Claims, 4 Drawing Sheets

100
190
150
144
148
194
162
182
196
160
158
164
170
146
192
106
168
174
178
166
184
176
172
104
102
156
152

140
120
134
142
128
116
124
112
110
122
126

114
108
118
132
130

APPARATUS FOR BENDING METAL WOOD GOLF CLUB HEADS

BACKGROUND OF THE INVENTION

The present invention relates generally to "wood-type" golf club heads which are molded of one of a number of metals such as steel or aluminum and, more particularly, to apparatus for bending the hosels of such golf club heads to adjust their lie and face angles for fitting a golf club to an individual golfer. These "wood-type" metal golf club heads will be referred to herein as metal wood golf club heads.

Custom fitting golf clubs can substantially improve a golfer's performance by adjusting characteristics of the clubs to take advantage of or compensate for intrinsic characteristics of a golfer's swing. For example, a series of apparently identical golf clubs can be made to perform in a range of differing manners by selecting a corresponding range of face angles for the clubs. For a series of identical clubs with the same loft, as the face angle is opened, moved toward an open (slice) face angle, the clubs will hit the ball progressively lower than the clubs preceding it in the series which have less open or more closed (hook) face angles.

The lie and face angle of a wood-type golf club having a wood head can be defined by selecting the drill angle on the hosel or neck of the wood head. The neck is then turned in alignment with the drilled hole. Unfortunately, for metal wood golf club heads, drilling and turning operations to determine the face angle and possibly the lie angle are impractical. While it would be possible to form a variety of metal wood heads having varying lie angles and varying face angles, the mold costs and inventory problems are prohibitive. Accordingly, alternate approaches have been used.

In one approach disclosed in U.S. Pat. No. 4,804,184, which is assigned to the assignee of the present application and incorporated herein by reference, runners are formed on the soles of the metal wood heads. The runners are ground down to select lie and/or face angles for clubs using the heads. With improvements in currently available metal wood golf club heads, it is also now possible to bend the hosels of these club heads to select lie and/or face angle.

For hosel bending, the club heads must be securely clamped in a stable position. The hosel is then engaged by a bending tool and force is applied via the bending tool to bend the hosel as desired. Unfortunately, problems are frequently encountered when the hosels of metal wood club heads are bent using known bending apparatus. In particular, metal wood golf club heads have thin wall thickness due to the weight limitations for these clubs and often dent or crush when being clamped for hosel bending operations. Further, the application of a bending tool to the hosels of metal wood golf club heads can mar the heads during the bending operation.

It is thus apparent that there is a need for improved apparatus for bending the hosels of metal wood golf club heads to adjust the lie and face angles of the club heads with reduced risk of denting, crushing and marring the club heads during the bending operation.

SUMMARY OF THE INVENTION

This need is met by the apparatus of the present invention wherein a metal wood golf club head having a hosel to be bent to alter the characteristics of a golf club incorporating the head is clamped into a rigid clamping framework using a pair of clamps which engage the top and the back of the club head. Improved bending bar means having an adjustable throat for engaging the hosel of the club head is then used to bend the hosel as required. The throat of the bending bar means is defined by material which is softer than the golf club head to substantially eliminate marring of the club head.

The back of the club head is engaged by an elongated pad of polymeric material made up of a back gripping plate to which the pad is secured with the pad being formed to receive the back of the club head.

The top of the club head is engaged by a pair of club head gripping areas which are formed to spread the top head gripping forces over two relatively large areas on the top of the golf club head. Preferably, the gripping areas are formed as a single polymeric pad which is bifurcated to define the gripping areas. The top gripping pad is secured to a top gripping plate. The gripping areas are also separated from one another by a distance which places the gripping forces substantially over the toe and heel portions of the club head which are better able to withstand the application of force without denting or crushing.

The back and top clamps are operated by threaded screws which are threadedly engaged with portions of the rigid clamping framework and include rounded ends for pivotally engaging correspondingly rounded dimples formed in the back and top gripping plates.

The bending bar means comprises a rigid bending bar having one end which is threadedly extended through a first end of a hosel receiving member. The hosel receiving member includes a hosel receiving opening between its first end and a second end. The second end of the hosel receiving member together with the distal end of the rigid bending bar define the hosel receiving throat which is adjusted by rotating the rigid bending bar to threadedly advance or withdraw the bending bar in the opening of the hosel receiving member. In a working embodiment of the present invention, the hosel receiving throat is defined by first and second hosel holding means made of brass and being secured to the second end of the hosel receiving member and the distal end of the rigid bending bar, respectively.

In accordance with one aspect of the present invention, apparatus for bending a hosel of a metal wood golf club head comprises clamping means for gripping a thick bulbous portion of a metal wood golf club head having a hosel which is to be bent to alter the characteristics of a club constructed using the metal wood golf club head. Bending bar means are provided for engaging and bending the hosel of the metal wood golf club head, the bending bar means including an adjustable throat for gripping the hosel.

The bending bar means may comprise a rigid bending bar having a handle end for manually grasping the bar and a threaded end, and a hosel receiving member having a first end and a second end and an opening in its side between the first and second ends for receiving the hosel in the opening. The hosel receiving member includes a threaded opening through its first end for receiving the threaded end of the rigid bending bar therethrough, the adjustable throat of the bending bar means being defined by the second end of the hosel receiving member and a distal end of the rigid bending bar. The rigid bending bar is grasped by the handle end and rotated about its central axis to threadedly advance or withdraw the distal end of the bar relative to the second end of the hosel receiving member to adjust the throat and thereby to receive and grip the hosel.

The hosel bending apparatus preferably further comprises mar inhibiting means associated with the rigid bending bar and the hosel receiving member for substantially eliminating marring of the metal wood golf club head during hosel bending operations. The mar inhibiting means may comprise first hosel holding means secured to the second end of the hosel receiving member for engaging a hosel gripped in the throat, and second hosel holding means secured to the distal end of the rigid bending rod within the opening for engaging a hosel gripped in the throat. The first and second hosel holding means are made of a material softer than the metal wood golf club head, for example, brass.

To better engage the hosel, the first hosel holding means may define a channel generally perpendicular to the opening for receiving a hosel of a metal wood golf club head in the channel. The second hosel holding means may comprise a cap nut secured to the distal end of the threaded end of the rigid bending rod. Preferably the cap nut has a substantially flat outer closed end to define an extended hosel engaging surface.

The clamping means preferably comprises a rigid framework for receiving the metal wood golf club head. Sole receiving means are provided within the rigid framework for receiving a sole of the metal wood golf club head. Face engaging means are provided within the rigid framework for receiving a face of the metal wood golf club head. Back gripping means within the rigid framework provide for engaging and clamping the back of the metal wood golf club head and forcing the face of the metal wood golf club head into the face engaging means. Bifurcated top head gripping means within the rigid framework provide for engaging and clamping the top of the metal wood golf club head at two top head gripping locations and forcing the sole of the metal wood golf club head into the sole receiving means, a first of the two top head gripping locations being positioned toward the toe of the metal wood golf club head and a second of the two top head gripping locations being positioned toward the heel of the metal wood golf club head.

The rigid framework may comprises an upper member for supporting the bifurcated top head gripping means, a lower member for supporting the sole receiving means, a club face receiving member for supporting the face engaging means, and a club back receiving member for supporting the back gripping means. The back gripping means preferably comprises a back gripping plate having back gripping pad means secured thereto for frictionally engaging the back of the metal wood golf club. First screw means threadedly engage the club back receiving member and pivotally engaging the back gripping plate for forcing the back gripping means into the back of the metal wood golf club head. The back gripping pad means is formed of a polymeric material and has an arcuate face for gripping the back of the metal wood golf club head.

The first screw means comprises two screws having rounded distal ends and being threadedly engaged with the club back receiving member. The back gripping plate includes two arcuate dimples formed therein opposite to the back gripping pad and positioned for pivotally receiving the rounded distal ends of the two screws. The bifurcated top head gripping means comprises a top gripping plate having top gripping pad means of polymeric material secured thereto for frictionally engaging the top of the metal wood golf club head at two top head gripping locations located at opposite ends of the top gripping plate. Second screw means threadedly engage the upper member and pivotally engaging the top gripping plate for forcing the top gripping pad means into the top of the metal wood golf club head.

The second screw means comprises a single screw having a rounded distal end and being threadedly engaged with the upper member. To permit adjustment of the top head gripping means, the top gripping plate includes a plurality of arcuate dimples formed therein opposite the top gripping pad means, each of the plurality of arcuate dimples being formed to pivotally receive the rounded distal end of the single screw. The sole receiving means comprises a pad of polymeric material and the face engaging means comprises an angular block of polymeric material secured to the club face receiving member.

In accordance with another aspect of the present invention, apparatus for bending a hosel of a metal wood golf club head comprises clamping means for gripping a thick bulbous portion of a metal wood golf club head having a hosel which is to be bent to alter the characteristics of a club constructed using the metal wood golf club head, and bending bar means for engaging and bending the hosel of the metal wood golf club head. The clamping means comprises a rigid framework for receiving the metal wood golf club head. Sole receiving means within the rigid framework provide for receiving a sole of the metal wood golf club head. Face engaging means within the rigid framework provide for receiving a face of the metal wood golf club head. Back gripping means within the rigid framework provide for engaging and clamping the back of the metal wood golf club head and forcing the face of the metal wood golf club head into the face engaging means. And, bifurcated top head gripping means within the rigid framework provide for engaging and clamping the top of the metal wood golf club head at two top head gripping locations and forcing the sole of the metal wood golf club head into the sole receiving means, a first of the two top head gripping locations being positioned toward the toe of the metal wood golf club head and a second of the two top head gripping locations being positioned toward the heel of the metal wood golf club head. The bending bar means comprises an adjustable throat for gripping the hosel.

Thus, it is an object of the present invention to provide improved apparatus for bending the hosels of metal wood golf club heads to adjust the lie and face angles of the club heads with reduced risk of denting, crushing and marring the club heads during the bending operation; to provide improved apparatus for bending the hosels of metal wood golf club heads by clamping the heads by means of padded clamps which grip the back of the club head and two enlarged areas of the top of the club head near the toe and heal of the club head; and, to provide improved apparatus for bending the hosels of metal wood golf club heads by bending the hosel of clamped golf club heads by means of a bending bar which defines an adjustable throat for receiving the hosels of the club heads, the throat having hosel engaging members formed of a material softer than the golf club heads.

Other objects and advantages of the invention will be apparent from the following description, the accompanying drawings and the appended claims.

BRIEF DESCRIPTION OF THE DRAWINGS

FIG. 9 is a sectional view of the bifurcated top head of FIG. 7;

DETAILED DESCRIPTION OF THE INVENTION

Figure 1:
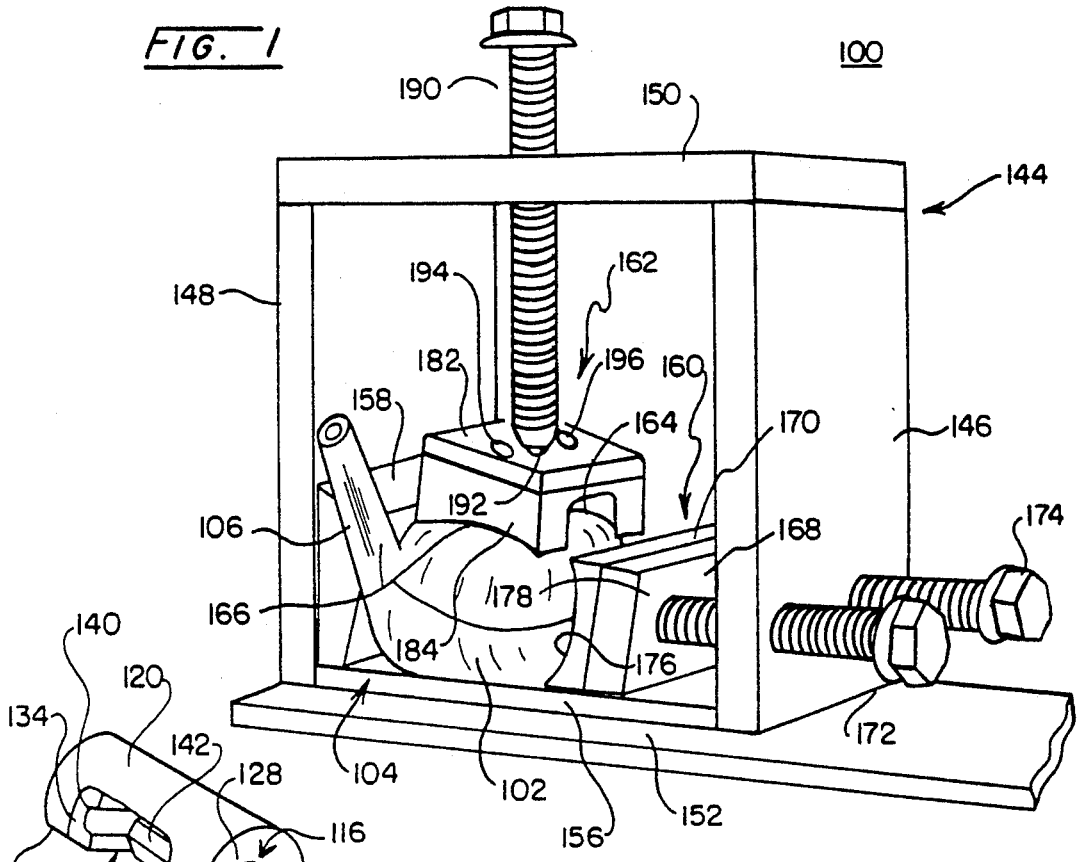
FIG. 1 is a perspective view of a metal wood golf club head clamped and ready for hosel bending.

The apparatus of the present invention for bending hosels of metal wood golf club heads will now be described with reference to the drawing figures. As shown in FIGS. 1, the apparatus comprises clamping means 100 for gripping a thick bulbous portion 102 of a metal wood golf club head 104 having a hosel 106 which is to be bent to alter characteristics of a club constructed by securing a shaft in the hosel 106 in a well known manner.

Figure 2:
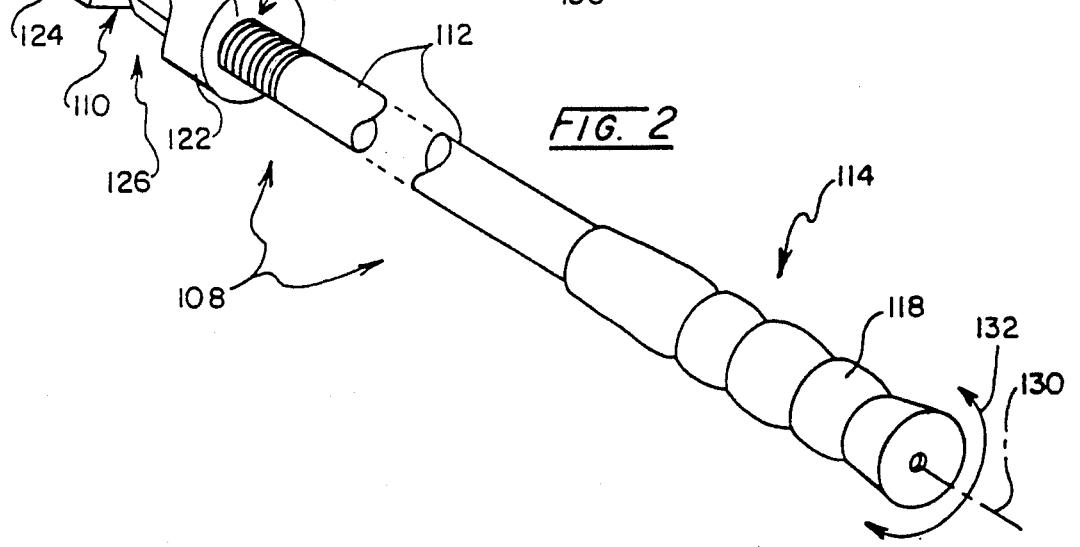
FIG. 2 is a perspective view of bending bar means used for bending the hosel of the golf club head of FIG. 1.

FIG. 2 illustrates in perspective bending bar means 108 which is used for engaging and bending the hosel 106 of the metal wood golf club head 104 to alter its lie and/or face angle as desired. The bending bar means 108 includes an adjustable throat 110 for gripping the hosel 106 prior to performing the bending operation.

Figure 11:
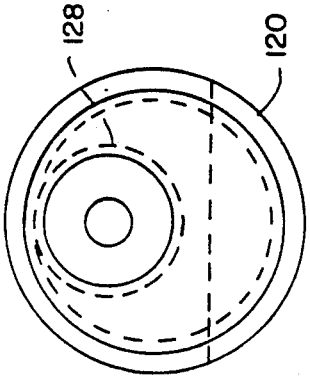
FIGS. 10 and 11 are side and end views, respectively, of a hosel receiving member of the bending bar means of FIG. 2.
Figure 13:
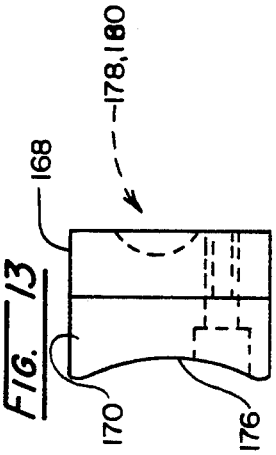
FIGS. 12 and 13 are front and side views, respectively, of back gripping means.
Figure 10:
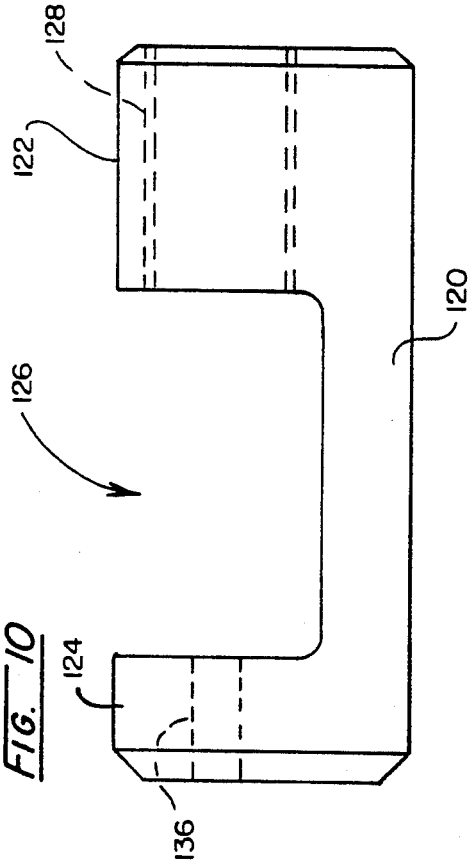
Figure 12:
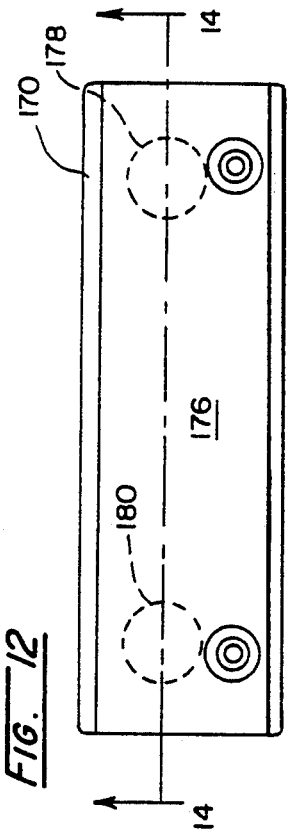
Figure 14:
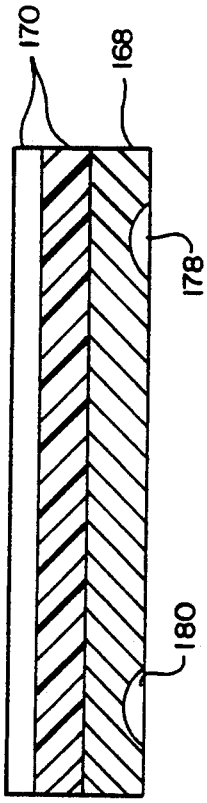
FIG. 14 is a sectional view of the back gripping means of FIGS. 12 and 13 taken along the section line 14—14 of FIG. 12.

The bending bar means 108 comprises a rigid bending bar 112 having a handle end 114 for manually grasping the bending bar 112 in a users hand, and a threaded end 116. In the illustrated embodiment, a hollow plastic grip 118 has been forced over the handle end 114 to receive a users hand. Associated with the rigid bending bar 112 to form the bending bar means 108 is a hosel receiving member 120 which is shown in more detail in FIGS. 10 and 11. The hosel receiving member 120 has a first end 122 and a second end 124 with an opening 126 for receiving a hosel to be bent in its side between the first and second ends 122, 124.

A threaded opening 128 is formed through the first end 122 of the hosel receiving member 120 for threadedly receiving the threaded end 116 of the rigid bending bar 112. The threaded end 116 of the rigid bending bar 112 is threaded through the opening 128 such that the distal end of the rigid bending bar 112 extends into the opening 126. Broadly speaking, the throat 110 for receiving a hosel to be bent is defined by the second end 124 of the hosel receiving member 120 and the distal end of the rigid bending bar 112; however, it is preferred to line the throat 110 with material softer than the golf club head 104 to reduce the possibility of marring the head during a hosel bending operation.

The throat 110 is adjusted to receive and grip the hosel 106 by rotating the rigid bending bar 120 about its central axis 130 while maintaining the hosel receiving member 120 in a fixed position. As shown by the arrow 132, the rigid bending bar 120 can be rotated in either direction about the axis 130. If the hosel receiving member 120 is maintained in a fixed position while the rigid bending bar 112 is rotated, it is apparent that the extension of the distal end of the rigid bending bar 112 into the opening 126 changes. The extension of the rigid bending bar 112 into the opening decreases for counterclockwise rotation to enlarge the throat 110; and, the extension of the rigid bending bar 112 into the opening increases for clockwise rotation to reduce the size of the throat 110.

Figure 3:
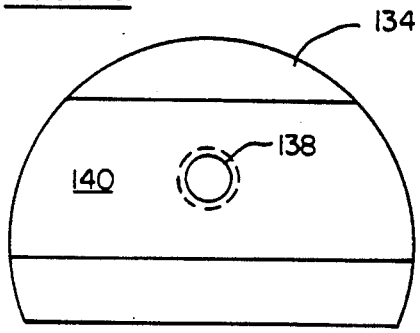
FIGS. 3 and 4 are front and side views, respectively, of first hosel holding means.
Figure 4:
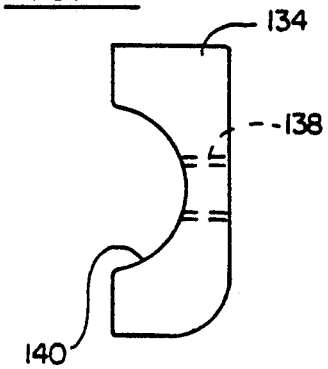
Figure 5:
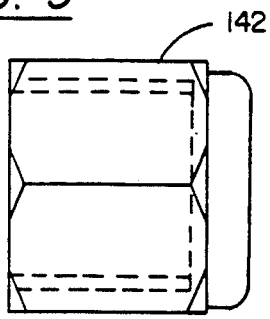
FIGS. 5 and 6 are side and top views, respectively, of second hosel holding means comprising a flat-top cap nut as illustrated.
Figure 6:
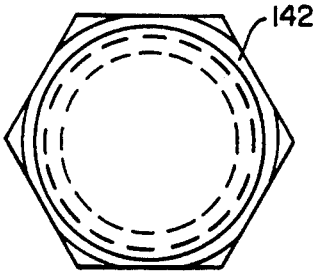
Figure 9:
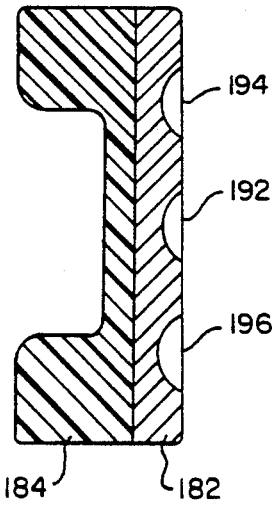
FIG. 9 is a sectional view of the bifurcated top head gripping means of FIGS. 7 and 8 taken along the section line 9—9

The bending apparatus of the present invention further comprises mar inhibiting means which effectively line the throat 110 with material softer than the golf club head 104 for substantially eliminating marring of the club head during hosel bending operations. In the illustrated embodiment, the mar inhibiting means comprises first hosel holding means illustrated in FIGS. 2, 3 and 4, and second hosel holding means illustrated in FIGS. 2, 5 and 6.

The first hosel holding means comprises a semicylindrical brass insert 134 which is received within the opening 126 of the hosel receiving member 120. The insert 134 is secured to the second end 124 of the hosel receiving member 120 by a screw (not shown) which passes through an opening 136 in the second end 124 of the member 120 and engages a threaded opening 138 in the insert 134. The first hosel holding means defines a channel 140 which is oriented generally perpendicular to the opening 126 when the insert 134 is secured therein. The channel 126 receives hosels to be bent using the present invention.

In the illustrated embodiment, the second holding means comprises a flat-top brass cap nut 142 which is threaded onto the distal end of the threaded end 116 of the rigid bending bar 112. Thus, the throat 110 of the bending bar means 108 is effectively lined with brass which is softer than the metal wood golf club 104 to thereby prevent marring of the club during hosel bending. As will be apparent to those skilled in the art, other materials can be used for lining the throat 110; however, brass has proved effective and is presently preferred.

For hosel bending, metal wood golf clubs must be securely clamped in a stable position. Clamping frequently is problematic in that the thin walls of metal wood golf clubs may dent or crush when clamping forces are applied. To overcome these problems, the clamping means 100 of the present invention are utilized. The clamping means 100 comprises a rigid framework 144 which is made up of: a club back receiving member 146; a club face receiving member 148; an upper member 150; and, a lower member 152.

Sole receiving means comprising a polymeric, preferably polyethylene, sole pad 156 is supported by the lower member 152 of the rigid framework 144 for receiving a sole of the metal wood golf club head 104. Face engaging means comprising an angular block of polymeric material or face pad 158 is supported by and secured to the club face receiving member 148 of the rigid framework 144 for receiving a face of the metal wood golf club head 104. Back gripping means 160 is supported by the club back receiving member 146 of the rigid framework 144 for engaging and clamping the back of the metal wood golf club head 104 and forcing its face into the face pad 158.

Bifurcated top head gripping means 162 is supported by the upper member 150 of the rigid framework 144 for engaging and clamping the top of the metal wood golf club head 104 at two top head gripping locations 164, 166 and forcing the sole of the metal wood golf club head 104 into the sole pad 156. A first one of the two top head gripping locations, location 164, is positioned toward the toe of the metal wood golf club head 104, and a second one of the two top head gripping locations, location 166, is positioned toward the heel of the metal wood golf club head 104 where the club head is better able to withstand clamping forces.

The back gripping means 160 as shown in FIGS. 1 and 12-14, comprises a back gripping plate 168 and back gripping pad means comprising a polymeric, preferably vinyl, back pad 170 secured to the back gripping plate 168 for example by screws (not shown), for frictionally engaging the back of the metal wood golf club 104. First screw means comprising screws 172, 174 threadedly engage the club back receiving member 146 and pivotally engage the back gripping plate 168 for forcing the back gripping means 160 into the back of the metal wood golf club head 104. The back pad 170 has an arcuate face 176 for better gripping the back of the metal wood golf club head 104.

The screws 172, 174 have rounded distal ends which engage arcuate dimples 178, 180 formed in the side of the back gripping plate 168 opposite to the back gripping pad 170 and positioned for pivotally receiving the rounded distal ends of the screws 172, 174.

Figure 7:
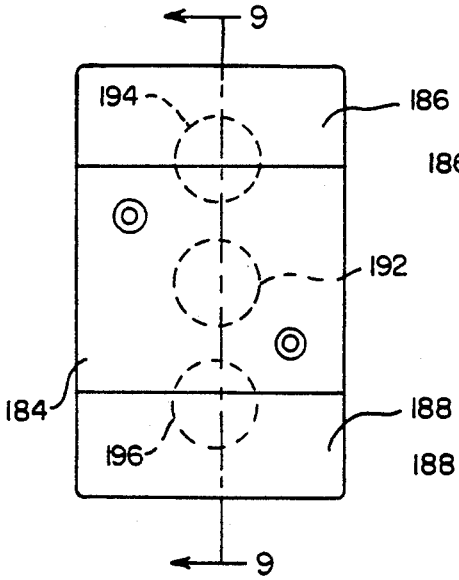
FIGS. 7 and 8 are bottom and side views, respectively, of bifurcated top head gripping means.
Figure 8:
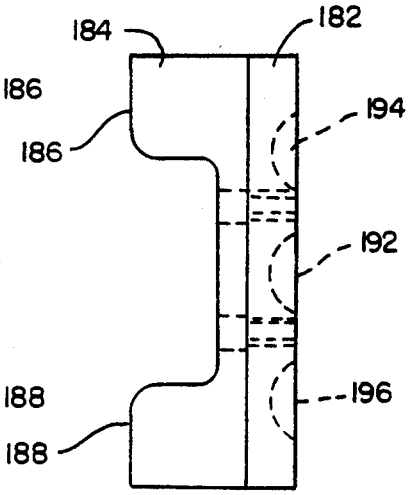

The bifurcated top head gripping means 162 as shown in FIGS. 1 and 7-9, comprises a top gripping plate 182 and top gripping pad means comprising a polymeric, preferably vinyl, bifurcated top pad 184 secured to the top gripping plate 182, for example by screws (not shown), for frictionally engaging the top of the metal wood golf club head 104 at the two top head gripping locations 164, 166. The top head gripping locations 164, 166 are defined by pad portions 186, 188 located at opposite ends of the top gripping plate 182. As shown in FIG. 7, the pad portions 186, 188 define relatively large areas on the top of the golf club head 104 to distribute the clamping forces and thereby further lessen the possibility of denting or crushing the head.

Second screw means comprises a screw 190 threadedly engaging the upper member 150 and pivotally engaging the top gripping plate 182 for forcing the top pad 184 and, more particularly the pad portions 186, 188, into the top of the metal wood golf club head 104. The screw 190 has a rounded distal end which engages one of a plurality of dimples, three arcuate dimples 192, 194, 196 in the illustrative embodiment, formed in the side of the top gripping plate 182 opposite to the top pad 184. As shown in FIG. 1, the screw 190 engages the middle dimple 192; however, the outer dimples 194, 196 permit the bifurcated top head gripping means 162 to be moved around within the rigid framework 144 to provide a variety of gripping positions for better adapting to various sizes of metal wood golf clubs.

Hosel bending operations using the apparatus of the present invention should be apparent from the foregoing description of the apparatus. However, the orientation of a clamped metal wood golf club and the bending bar are further illustrated in the perspective view of FIG. 15 wherein the clamping apparatus has been partially cut away for ease of illustration.

Figure 15:
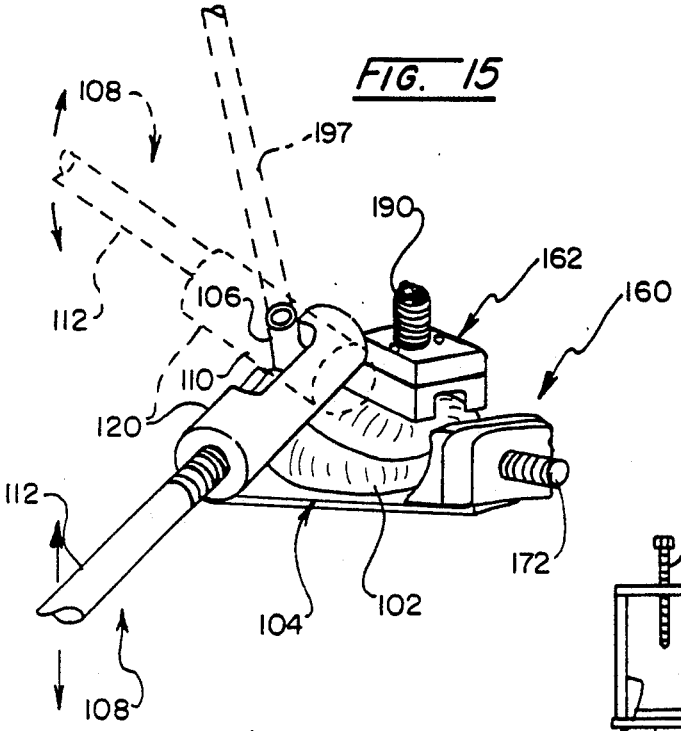
FIG. 15 is a perspective view, partially cut away, of a hosel bending operation on a golf club head.

As shown in FIG. 15, the club head 104 has been securely clamped by the back gripping means 160 and the bifurcated top head gripping means 162. The hosel 106 is then engaged by the bending bar means 108 by initially opening the throat 110 by rotating the bar 112 in a counterclockwise direction and placing the throat 110 around the hosel 106. The throat 110 is then closed by rotating the bar 112 in a clockwise direction until the hosel 106 is securely gripped by the bending bar means 108.

The hosel 106 is then ready to be bent as desired by applying an appropriate force to the handle end 114 of the bending bar 112. The bending bar means 108 is positioned as shown in the solid line drawing of FIG. 15 for adjusting the lie angle; and, the bending bar means 108 is positioned as shown in the dotted line drawing of FIG. 15, with the bar 112 generally parallel to the front of the rigid framework 144 of the clamping means 100, for adjusting the face angle. It is noted that if an unshafted club head is to be bent, a support rod 197 should be inserted into the hosel 106 to prevent the hosel 106 from being squeezed out of round during the bending operation.

Figure 16:
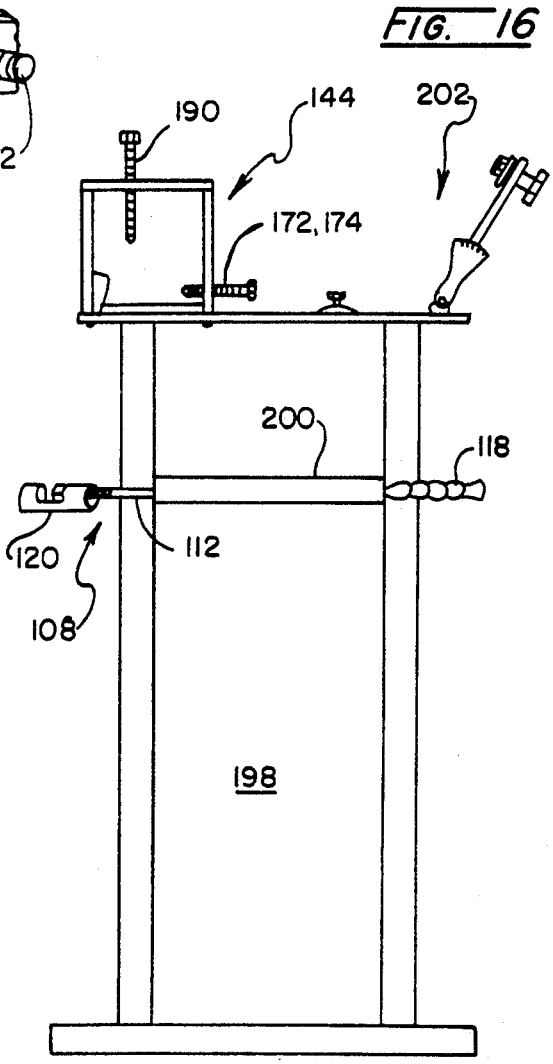
FIG. 16 is a front view of a hosel bending station incorporating the apparatus of the present invention.

While the apparatus of the present invention can be installed in a variety of ways in a workshop, FIG. 16 illustrates a preferred stand 198 which supports the rigid framework 144 of the clamping means 100 on an uppermost surface. The stand 198 also includes a tray 200 for supporting elements required for clamping golf club heads as well as the bending bar means 108. The stand 198 also advantageously includes club measurement apparatus 202 for measuring characteristics of club heads whose hosels are being bent to facilitate accurate bending and verification that desired characteristics have been achieved. Of course such club head measuring or gauging apparatus can be provided separate from the bending apparatus of the present invention if desired.

Having thus described the invention of the present application in detail and by reference to preferred embodiments thereof, it will be apparent that modifications and variations are possible without departing from the scope of the invention defined in the appended claims.

What is claimed is:

1. Apparatus for bending a hosel of a metal wood golf club head comprising:

clamping means for gripping a thick bulbous portion of a metal wood golf club head having a hosel which is to be bent to alter the characteristics of a club constructed using the metal wood golf club head;

bending bar means for engaging and bending said hosel of said metal wood golf club head, said bending bar means including an adjustable throat for gripping said hosel; and mar inhibiting means associated with said adjustable throat of said bending bar means for substantially eliminating marring of said metal wood golf club head during hosel bending operations.

2. Hosel bending apparatus as claimed in claim 1 wherein said bending bar means comprises:

a rigid bending bar having a handle end for manually grasping said bar and a threaded end; and a hosel receiving member having a first end and a second end and an opening in its side between said first and second ends for receiving said hosel therein, said hosel receiving member including a treaded opening through its first end for receiving the threaded end of said rigid bending bar therethrough, said throat of said bending bar means being defined by said second end of said hosel receiving member and a distal end of said rigid bending bar, said rigid bending bar being grasped by said handle end and rotated about a central axis of said bar to threadedly advance or withdraw said distal end of said bar relative to said second end of said hosel receiving member to adjust said throat and thereby to receive and grip said hosel.

3. Hosel bending apparatus as claimed in claim 2 wherein said mar inhibiting means comprises:

first hosel holding means secured to said second end of said hosel receiving member for engaging a hosel gripped in said throat; and second hosel holding means secured to the distal end of said rigid bending rod within said opening for engaging a hosel gripped in said throat, said first and second hosel holding means being made of a material softer than said metal wood golf club head.

4. Hosel bending apparatus as claimed in claim 3 wherein said material comprises brass.

5. Hosel bending apparatus as claimed in claim 4 wherein said first hosel holding means defines a channel generally perpendicular to said opening for receiving a hosel of a metal wood golf club head in said channel.

6. Hosel bending apparatus as claimed in claim 5 wherein said second hosel holding means comprises a cap nut secured to said distal end of said threaded end of said rigid bending rod.

7. Hosel bending apparatus as claimed in claim 6 wherein said cap nut has a substantially flat outer closed end.

8. Apparatus for bending a hosel of a metal wood golf club head comprising:

clamping means for gripping a thick bulbous portion of a metal wood golf club head having a hosel which is to be bent to alter the characteristics of a club constructed using the metal wood golf club head, said clamping means comprising:

a rigid framework for receiving said metal wood golf club head;

sole receiving means within said rigid framework for receiving a sole of said metal wood golf club head;

face engaging mean within said rigid framework for receiving a face of said metal wood golf club head;

back gripping means within said rigid framework for engaging and clamping a back of said metal wood golf club head and forcing said face of said metal wood golf club head into said face engaging means; and bifurcated top head gripping means within said rigid framework for engaging and clamping a top of said metal wood golf club head at two top head gripping locations and forcing said sole of said metal wood golf club head into said sole receiving means, a first of said two top head gripping locations being positioned toward a toe of said metal wood golf club head and a second of said two top head gripping locations being positioned toward a heel of said metal wood golf club head; and bending bar means for engaging and bending said hosel of said metal wood golf club head, said bending bar means including an adjustable throat for gripping said hosel.

9. Hosel bending apparatus as claimed in claim 8 wherein said rigid framework comprises:

an upper member for supporting said bifurcated top head gripping means;

a lower member for supporting said sole receiving means;

a club face receiving member for supporting said face engaging means; and a club back receiving member for supporting said back gripping means.

10. Hosel bending apparatus as claimed in claim 9 wherein said back gripping means comprises:

a back gripping plate;

back gripping pad means secured to said back gripping plate for frictionally engaging the back of said metal wood golf club; and first screw means threadedly engaging said club back receiving member and pivotally engaging said back gripping plate for forcing said back gripping means into the back of said metal wood golf club head.

11. Hosel bending apparatus as claimed in claim 10 wherein said back gripping pad means is formed of a polymeric material and has an arcuate face for gripping the back of said metal wood golf club head.

12. Hosel bending apparatus as claimed in claim 11 wherein said first screw means comprises two screws having rounded distal ends and being threadedly engaged with said club back receiving member, said back gripping plate including two arcuate dimples formed therein opposite to said back gripping pad and positioned for pivotally receiving said rounded distal ends of said two screws.

13. Hosel bending apparatus as claimed in claim 12 wherein said bifurcated top head gripping means comprises:

a top gripping plate;

top gripping pad means secured to said top gripping plate for frictionally engaging the top of said metal wood golf club head at two top head gripping locations located at opposite ends of said top gripping plate; and second screw means threadedly engaging said upper member and pivotally engaging said top gripping plate for forcing said top gripping pad means into the top of said metal wood golf club head.

14. Hosel bending apparatus as claimed in claim 13 wherein said top gripping pad means is formed of a polymeric material.

15. Hosel bending apparatus as claimed in claim 14 wherein said second screw means comprises a single screw having a rounded distal end and being threadedly engaged with said upper member, said top gripping plate including a plurality of arcuate dimples formed therein opposite said top gripping pad means, each of said plurality of arcuate dimples being formed to pivotally receive said rounded distal end of said single screw.

16. Hosel bending apparatus as claimed in claim 5 wherein said sole receiving means comprises a pad of polymeric material.

17. Hosel bending apparatus as claimed in claim 16 wherein said face engaging means comprises an angular block of polymeric material secured to said club face receiving member.

18. Apparatus for bending a hosel of a metal wood golf club head comprising:

clamping means for gripping a thick bulbous portion of a metal wood golf club head having a hosel which is to be bent to alter the characteristics of a club constructed using the metal wood golf club head, said clamping means comprising:

a rigid framework for receiving said metal wood golf club head;

sole receiving means within said rigid framework for receiving a sole of said metal wood golf club head;

face engaging means within said rigid framework for receiving a face of said metal wood golf club head;

back gripping means within said rigid framework for engaging and clamping a back of said metal wood golf club head and forcing said face of said metal wood golf club head into said face engaging means; and bifurcated top head gripping means within said rigid framework for engaging and clamping a top of said metal wood golf club head at two top head gripping locations and forcing said sole of said metal wood golf club head into said sole receiving means, a first of said two top head gripping locations being positioned toward a toe of said metal wood golf club head and a second of said two top head gripping locations being positioned toward a heel of said metal wood golf club head; and bending bar means for engaging and bending said hosel of said metal wood golf club head.

19. Hosel bending apparatus as claimed in claim 18 wherein said bending bar means comprises an adjustable throat for gripping said hosel.

20. Apparatus for bending a hosel of a metal wood golf club head comprising:

clamping means for gripping a thick bulbous portion of a metal wood golf club head having a hosel which is to be bent to alter the characteristics of a club constructed using the metal wood golf club head; and bending bar means for engaging and bending said hosel of said metal wood golf club head, said bending bar means comprising a rigid bending bar having a handle end for manually grasping said bar and a threaded end; and a hosel receiving member having a first end and a second end and an opening in its side between said first and second ends for receiving said hosel therein, said hosel receiving member including a threaded opening through its first end for receiving the threaded end of said rigid bending bar therethrough, said throat of said bending bar means being defined by said second end of said hosel receiving member and a distal end of said rigid bending bar, said rigid bending bar being grasped by said handle end and rotated about a central axis of said bar to threadedly advance or withdraw said distal end of said bar relative to said second end of said hosel receiving member to thereby provide an adjustable throat for gripping said hosel.

* * * * *

UNITED STATES PATENT AND TRADEMARK OFFICE

CERTIFICATE OF CORRECTION

PATENT NO. : 5,327,766

DATED : July 12, 1994

INVENTOR(S) : Todd F. Humphreys

It is certified that error appears in the above-indentified patent and that said Letters Patent is hereby corrected as shown below:

Col. 9, Line 9, "treaded opening" should be --threaded opening--.

Col.9, Line 55, "face engaging mean" should be --face engaging means--.

Col. 10, Line 64, "claim 5" should be --claim 15--

Signed and Sealed this

Twentieth Day of September, 1994

*Attest:*

*Attesting Officer*

BRUCE LEHMAN

*Commissioner of Patents and Trademarks*